United States Patent [19]

Wilkens

[11] 4,055,969

[45] Nov. 1, 1977

[54] METHOD AND APPARATUS FOR PRODUCING TERRY CLOTH TOWELING ON A WARP KNITTING MACHINE

[75] Inventor: Christian Wilkens, Offenbach, Germany

[73] Assignee: Karl Mayer Textilmaschinenfabrik GmbH, Germany

[21] Appl. No.: 727,073

[22] Filed: Sept. 27, 1976

[30] Foreign Application Priority Data

Oct. 1, 1975 Germany ..... 2543714

[51] Int. Cl.[2] ..... D04B 23/00; D04B 27/00

[52] U.S. Cl. ..... 66/204; 66/207; 192/33 R

[58] Field of Search ..... 66/203, 204, 207, 205, 66/154; 192/33 R

[56] References Cited

U.S. PATENT DOCUMENTS

| | | | |
|---|---|---|---|
| 2,499,656 | 3/1950 | Le Blanc | 66/207 |
| 3,527,066 | 9/1970 | Zwingenberger | 66/207 |
| 3,555,853 | 1/1971 | Diehl et al. | 66/87 |

*Primary Examiner*—Ronald Feldbaum
*Attorney, Agent, or Firm*—Behr & Woodbridge

[57] ABSTRACT

A displacing means is used to move at least one guide bar by at least one needle space in order to remove the loops on a terry cloth towel material such as knitted on a warp knitting machine. The displacing device basically comprises a transfer means for driving a second pattern gear wheel from a conventional first set of gear wheels, a cam follower arrangement operatively associated with the second set of pattern chains; a clutch means actuated by the cam follower mechanism, another cam actuated by the clutch and a cam follower and linkage mechanism associated with the clutch cam for moving the guide bar in the direction of its normal motion by at least one additional needle space. The transfer means comprises first and second coaxially mounted gears which are driven by an idler gear mounted near the periphery of the circumference of the first set of pattern chain wheel. In this manner a considerable reduction of speed is obtained between the first set of pattern cam wheels and the second set of pattern cam wheels. The clutch mechanism is spring-loaded and includes a Z-shaped lever which will engage an internal tab in response to release of the clutch by a pawl mechanism. The method and apparatus of the present invention makes it possible to knit towels having transverse strings which are useful both decoratively and for defining the area in which the cloth is cut into individual towels with pattern chains considerably shorter than those used in the prior art and also allows those towels to be knitted without altering the basic thread consumption rate.

31 Claims, 11 Drawing Figures

FIG. 9A
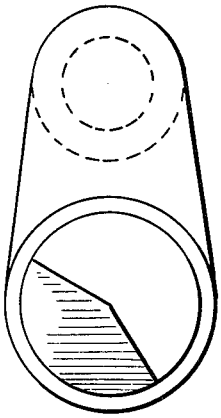
FIG. 9B
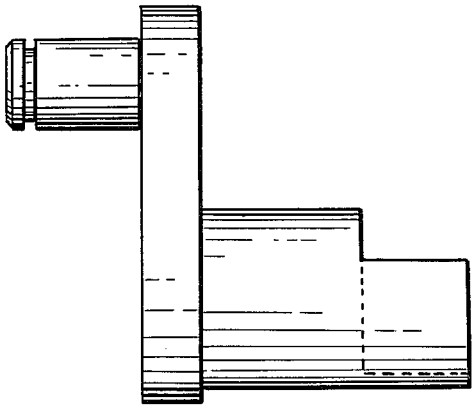
FIG. 10
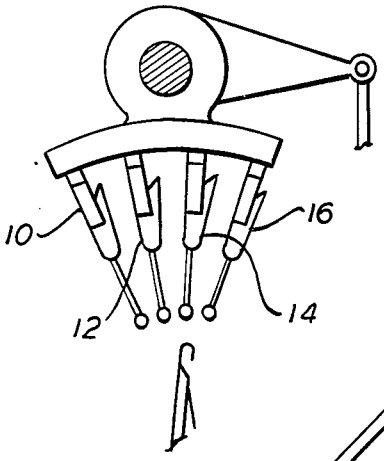
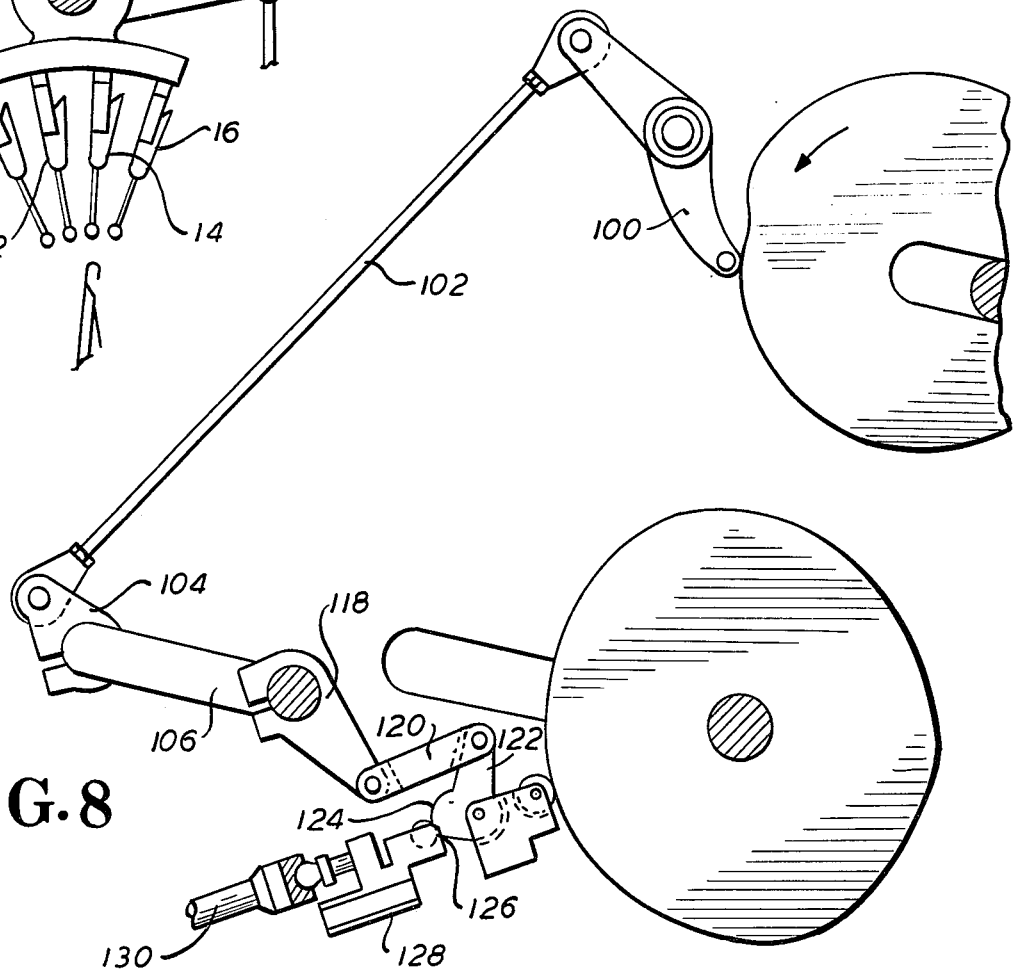
FIG. 8

METHOD AND APPARATUS FOR PRODUCING TERRY CLOTH TOWELING ON A WARP KNITTING MACHINE

BACKGROUND OF THE INVENTION

1. Field of the Invention

This invention relates to a method and apparatus for producing terry cloth toweling materials on a warp knitting machine.

2. Description of the Prior Art

Apparatus and methods for producing towel materials, especially terry cloth towels having non-looped transfer stripes, are known to those of ordinary skill in the art. Typical prior art apparatus and methods, however, required the use of so-called pattern change mechanisms. According to such prior art techniques the pattern was typically changed from the production of ware having loop stitches to ware without loop stitches by the displacement of appropriate guide bars by means of alteration of the pattern. Generally, the ratio of looped stitches to unlooped stitches is very great, usually in the order of fifty to one. This was so since the unlooped portions constituted a very small portion of the whole of the fabric. In order to achieve this ratio by conventional means it was usually necessary to employ extremely long pattern chains in order to provide the desired ratio. The use of such long patterned chains was of course extremely expensive as well as being mechanically bulky and inefficient. A further disadvantage of the aforedescribed traditional method lay in the fact that changing from looped to unlooped stitches and vice versa naturally altered the thread consumption rate of the machine. Therefore, the take off speed of the thread beams had to be modified for stitch change.

Machinery is described in the book "WARP KNITTING TECHNOLOGY" by D. F. Paling, Columbine Press Ltd., Copyright 1970, which could be adopted and modified to perform a similar function. However, the adaptation of such equipment would not produce machinery which would operate better than the invention described herein.

For these and other reasons a solution was sought which would dispense with the necessity of using long pattern chains.

SUMMARY OF THE INVENTION

Briefly described, the invention comprises an apparatus and method for displacing a selected guide bar by at least one needle space during the manufacture of a towel. A first set of pattern chain wheels is connected via a reducing gear system to a second set of pattern chain wheels. The gear reducing system comprises a first gear and a second gear coaxially attached to the same shaft. The first gear has a few less teeth than the second gear. An idler gear is attached to the periphery of the first pattern chain wheel and adapted to mesh with both the first and second gear simultaneously. A second set of patterned chain wheels is directly attached to the second gear. As the first set of pattern wheels revolves it causes the idler gear to circumscribe the peripheries of the first and second gears. Due to the discrepancy in the number of teeth between the first and second gears, the second set of pattern chain wheels is run at a speed of approximately 1/50 of that of the first set of pattern chain wheels. A cam follower system follows the motion of one chain of the second set of pattern chains and is designed to drive a pawl escape mechanism. The pawl is engageable with one of a pair of release tabs located around the periphery of the first plate of a clutch means. The clutch means includes three coaxially mounted plates, the first and second of which are spring-loaded by a biasing spring that connects the two. The second plate of the clutch means houses an Z-shaped lever which includes a cam following roller at one end adapted for engagement in a slot in the first plate. The other end of the Z-shaped lever includes a wedge shaped extension which is adapted to selectively engage with a tab connected to the third plate. The third plate has a cap-like shape and the tab is located on the interior periphery of the cap. Another cam is connected to the third plate. A cam follower and linkage mechanism follows the exterior of the cam and directs the movement of a lever which in turn moves the appropriate guide bar forward by at least one needle space.

The movement of the second pattern chain signals the release of the clutch mechanism which in turn causes the cam associated with the third plate of the clutch mechanism to advance approximately 180°. The cam follower which rides on that cam then advances the guide bar forward or backward through an intermediate linkage system. These and other features of the present invention will be more fully understood with reference to the following drawings and detailed description of the invention.

BRIEF DESCRIPTION OF THE DRAWINGS

FIG. 8 is a schematic illustration of the cam follower and linkage mechanism which actuates the guide bar driving lever.

FIGS. 9*a* and 9*b* are detailed views of the lever mechanism housed in the clutch assembly illustrated in FIG. 7.

FIG. 10 is an elevational view of guide bars 10, 12, 14 and 16 in position over a needle bed.

DETAILED DESCRIPTION OF THE INVENTION

During the course of this description like numbers will be used to indicate like elements according to the different figures illustrated herein.

Figure 1:
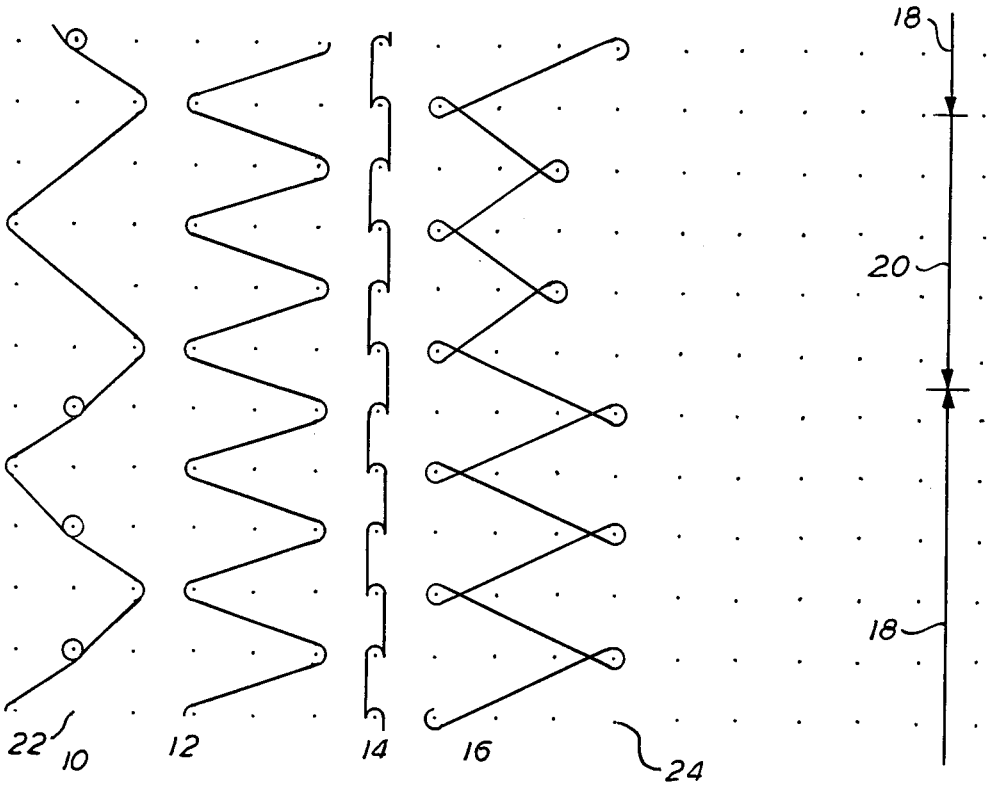
FIG. 1 PRIOR ART
FIG. 1 is a stitch diagram of a prior art method for producing terry cloth towel materials with non-looped stripes through the use of four guide bars on a warp knitting machine.

A prior art procedure for producing looped toweling having a non-looped stripe is illustrated in FIG. 1. The typical prior art warp knitting machine used for producing looped toweling included at least four guide bars. The front guide bars 10 worked with the loops on one side of the ware, guide bars 12 and 14 produced the ground pattern making fringe and finishing stitches, and the rearward guide bar 16 worked with the loops on the other side of the goods. Directional arrows 18 and 20 indicate the two different modes of stitch patterns knitted on the prior art warp knitting machines. In the mode of arrow 18, the formation of pile loops is shown. In the mode of arrow 20, the conversion of the goods into non-looped material is illustrated. The transfer from one mode 18 to another mode 20 and vice versa was achieved by a change in the pattern system wherein the displacement of guide bars 10 and 16 is so changed that guide bar 10 does not form a stitch on the empty needle 22 whereas, by displacement of guide bar 16 the pattern of 1–0 is changed into 2–1 and thus the stitches of these threads are held on the fringe needles which previously were thrown off onto the empty needle 24 for the formation of the loops. The physical arrangement of guide bars 10, 12, 14 and 16 is illustrated in FIG. 10.

Figure 2:
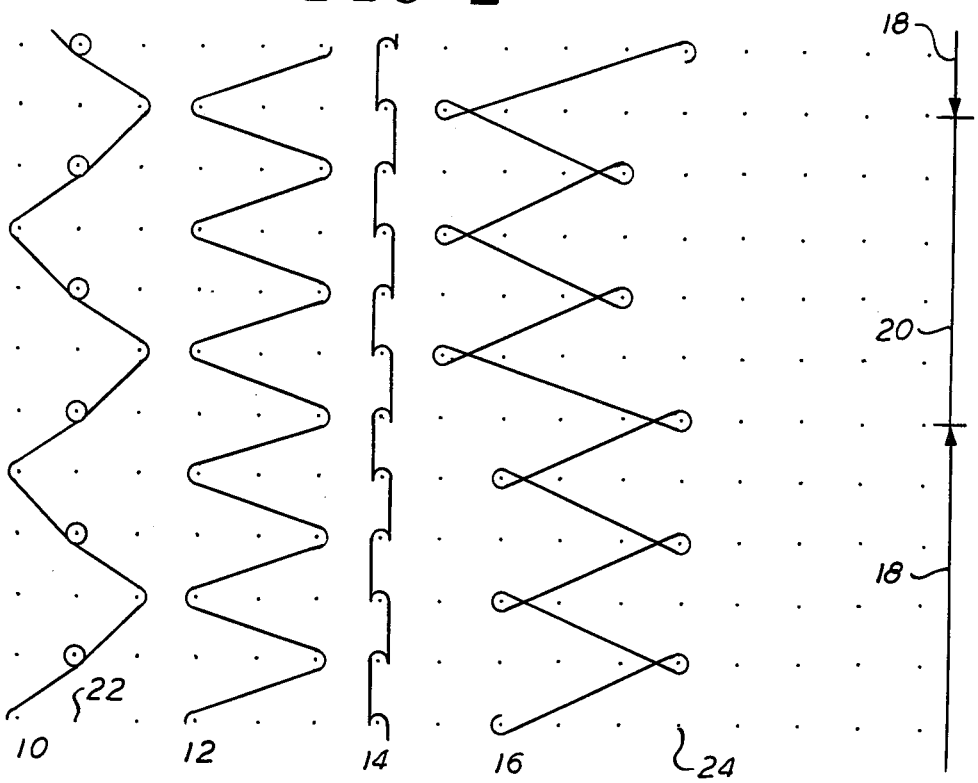
FIG. 2 is a stitch diagram of the method according to the preferred embodiment of the present invention for producing terry cloth towels.

The method according to the preferred embodiment of the present invention is illustrated in FIG. 2. The laying pattern of the forward guide bar 10 is in no way altered while the rearward guide bar 16 only undergoes a change in position. That is to say, the displacement pattern does not change but the guide bars merely move into a different null position. Or expressed conversely, guide bars 10, 12, 14, and 16 continue to knit in the same manner continuously throughout the knitting of the towel, the only difference being that guide bar 16 is occasionally displaced by at least one needle position. Under certain circumstances it may be desirable to displace guide bar 16 by more than one needle space. This is clear from observing the directional arrows 18 and 20' of FIG. 2. In the mode illustrated by the stitches in the section defined as arrow 18 the formation of loops as illustrated in FIG. 2 corresponds exactly with the mode of formation of loops as illustrated in prior art FIG. 1. On the other hand, as can be seen from the section defined as arrow 20' of FIG. 2, there is no change in the consumption of thread when the non-looped transverse band is formed. In the mode of arrows 2, the guide bar 16 moves off of needle 24 and the previously empty needle 22 now carries the stitch of the threads of guide bar 16 and the stitch of the previously empty needle 24 of guide bar 16 are now moved onto the fringe needles so that the stitches cannot be thrown off as in the previous manner.

Figure 3:
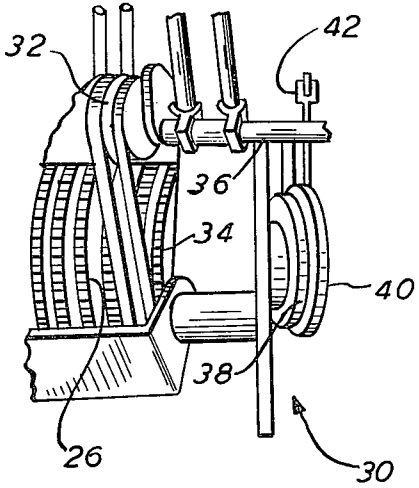
FIG. 3 is an assembly view of the apparatus according to the preferred embodiment of the present invention.

The apparatus 30 for automatically performing the method illustrated in FIG. 2 is illustrated in assembled form in FIG. 3. The apparatus includes a first pattern chain wheel and chain cam 26 which drives a gear down mechanism 28, not visible in FIG. 3, which in turn drives a second set of pattern chain wheels 32 and associated pattern chains 34. Associated with pattern chains 34 is a cam follower arrangement 36 which acts as a release actuating mechanism for clutch 38. Attached to clutch 38 is a cam 40 which drives a second cam follower and linkage arrangement 42. Linkage arrangement 42 also includes a guide bar lever device for propelling the guide bar forwardly or backwardly by at least one needle space.

Figure 4:
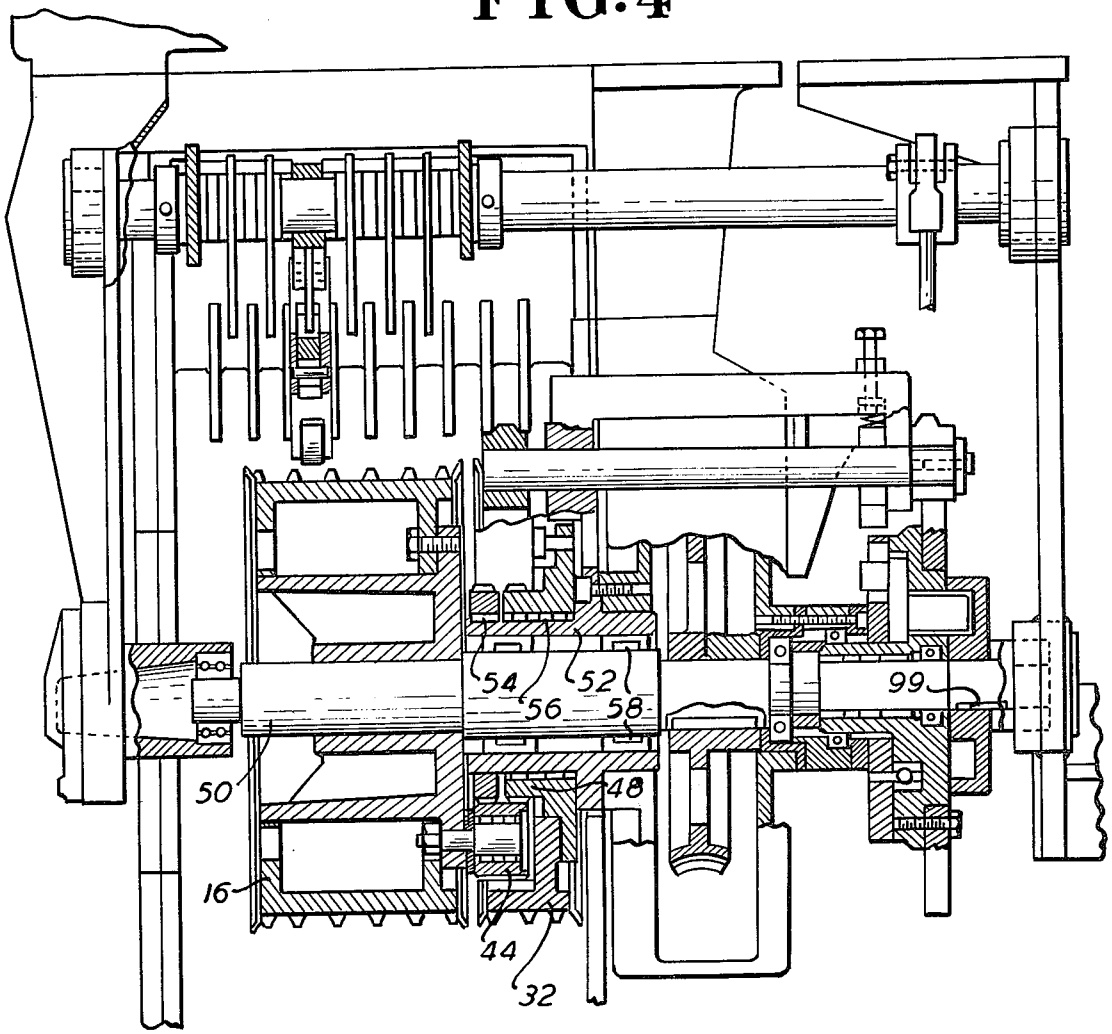
FIG. 4 is a cross-sectional view of the apparatus illustrated in FIG. 3.
Figure 5:
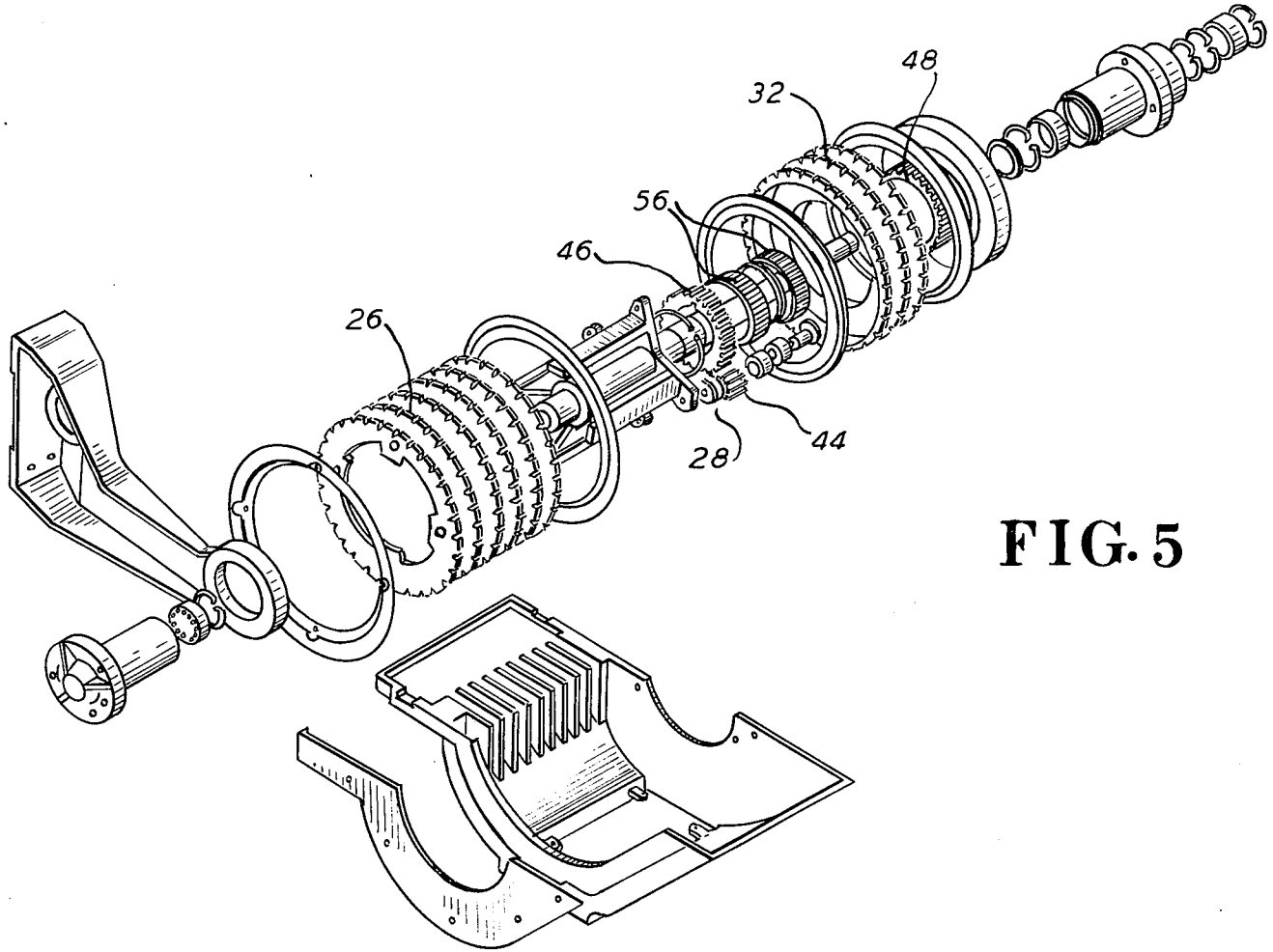
FIG. 5 is an exloded view of the speed reduction gear system.

One especially important aspect of the present invention is the gear down mechanism 38 which transfers some rotational motion from the first set of pattern wheels 26 to the second set of pattern wheels 32. The gear down mechanism 28 can be more fully understood with reference to FIGS. 4 and 5. FIG. 4 is a cross-sectional view of the apparatus 30 illustrated in FIG. 3. FIG. 5 is an exploded view of the gear down mechanism 28 as it appears between the first set of pattern chain wheels 26 and the second set of pattern chain wheels 32. The gear reduction mechanism 28 principally comprises an idler wheel 44 and a first and a second gear wheel 46 and 48 respectively which are concentrically mounted around common shaft 50. The first gear wheel 46 is keyed into rotatable mounting 52 by a key means 54. The second gear wheel 48 directly carries a second set of pattern chains around its periphery and is mounted on a set of one-way roller needle bearings 56. First and second gear wheels 48 and 46 are adapted to engage simultaneously with the teeth of idler gear wheel 44. Idler gear wheel 44 is rotatably attached to the first pattern chain wheel 16 at a point near its periphery. According to the preferred embodiment of the present invention the first gear wheel 46 has 94 teeth and the second gear wheel 48 has 96 teeth. The idler wheel 44 has 36 teeth. It is important that there be a small difference in the number of teeth between the first gear wheel 46 and the second gear wheel 48.

In operation, the first pattern chain wheel 16 is driven in a conventional manner about common shaft 50. This motion causes the idler gear wheel 44 to travel around the periphery of the first and second gear wheels 46 and 48. As the idler gear 44 travels in a circle it simultaneously engages the teeth of the first and second gear wheels 46. Since the second gear wheel 48 has in the illustrated Example 2 more teeth than the 96 teeth of the first gear wheel 46, then the second gear wheel 48 will be advanced by 2/96 of 1/48 each time a new tooth of the idler wheel 44 simultaneously engages a new tooth on the first gear wheel 46 and the second gear wheel 48. The one-way roller bearings 56 insure that there is no back slippage. The entire mounting assembly 52 is likewise supported by a set of roller bearings 58 separating it from common shaft 50. Viewed another way the mounting block 52 is adapted to travel backwards while the second gear wheel and its associated second set of pattern chain wheels 32 is driven forward at a slightly faster speed. In view of the ratio of the teeth the first gear wheel 46 will make 94 revolutions backwards while at the same time the second gear wheel 48 will make 96 revolutions forwards for a net forward rotation of 2 revolutions for the second pattern chain wheel 32 for every 96 revolutions of the first pattern chain wheel 16.

Figure 6:
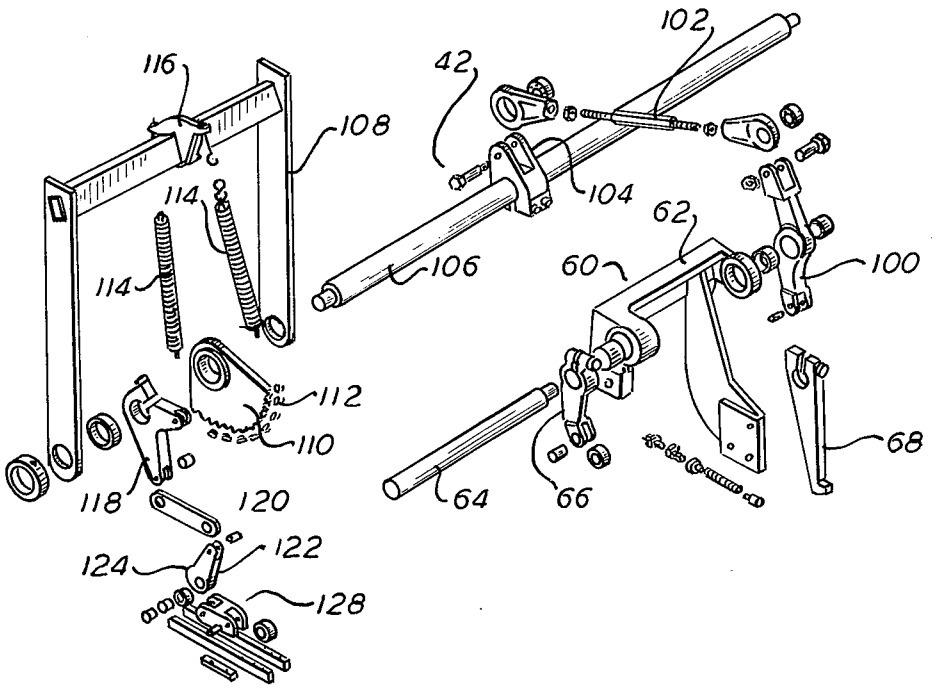
FIG. 6 is an exploded view of the actuating or release mechanism located between the second pattern gear wheel and the clutch mechanism.

A pair of pattern chains 34 is adapted to ride on the second pattern chain wheel 32. An actuator release means 60, as illustrated in FIG. 6, is adapted to follow the second pattern chain 34 and actuate the clutch 38 at selected intervals. The actuating release mechanism 60 includes a mounting bracket 62 and a common mounting shaft 64 which is attached to the mounting bracket 62. A cam follower unit 66 is rigidly attached to one end of the shaft 64. A pawl release 68 including a small hook-like end is rigidly attached at the other end of shaft 64. The movement of the cam follower 66 in response to the motion of the pattern chain causes the pawl 698 to move into and out of engagement with the clutch mechanism 38.

Figure 7:
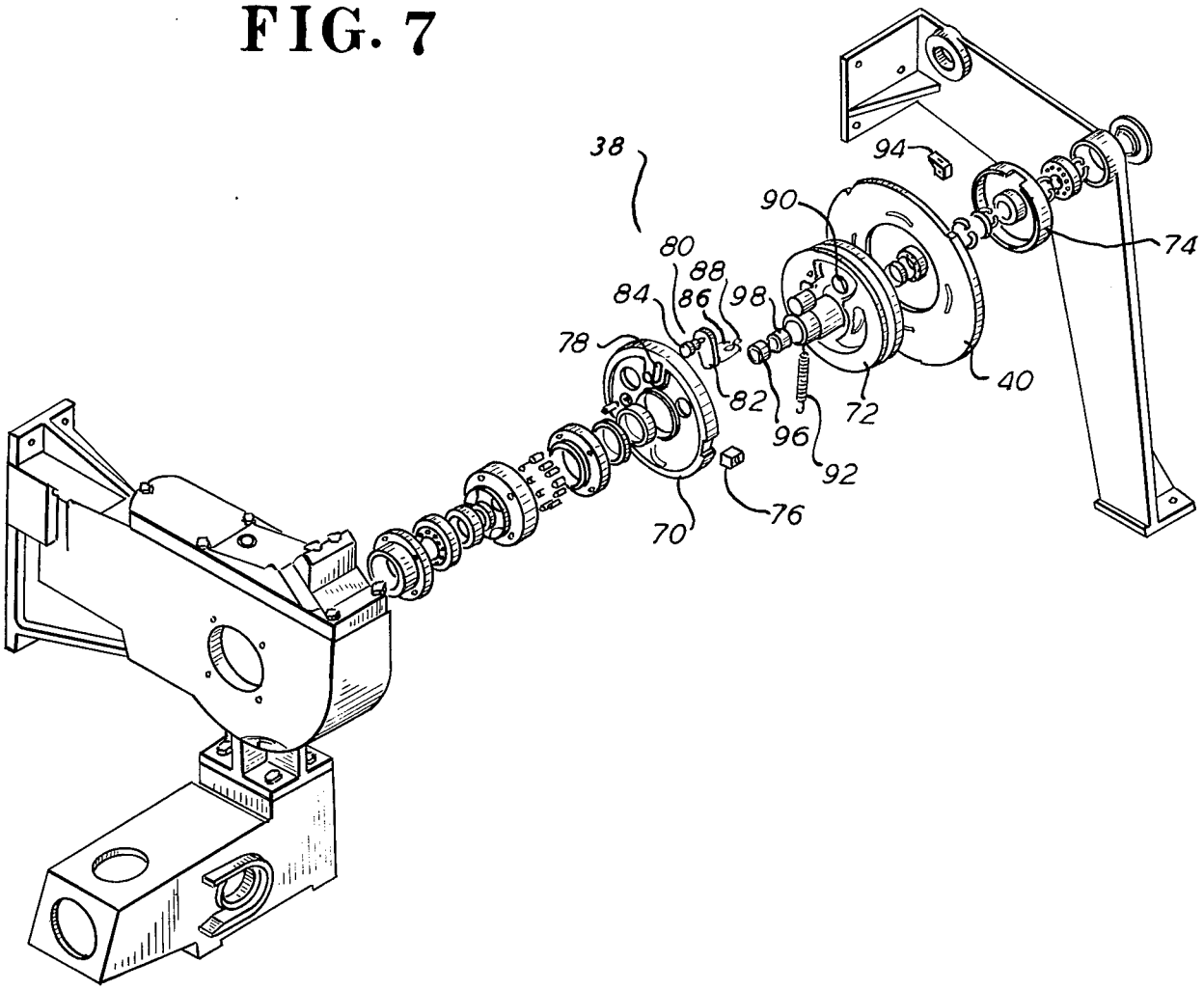
FIG. 7 is an exploded view of the clutch mechanism also illustrating a cam wheel.

The clutch mechanism 38 is illustrated in exploded detail in FIG. 7. The clutch mechanism 38 includes a first plate 70, a second plate 72 and a third plate 74. First plate 73 includes a pair of pawl engaging tabs 76 which are rigidly connected to the periphery of the first plate 70. A short slot 78 is located along a portion of the diameter of the first plate 70. The slot 78 is adapted to engage with Z-shaped lever 80. The Z-shaped lever 80 includes an L-shaped section 82 with a roller portion 84 adapted to engage in slot 78 of the first plate 70. The lever 80 also includes a rounded section 86 which terminates in a wedge shape face 88. Sections 86 and 88 of the lever 80 are adapted to pass through an aperture 90 in the second plate 72. The first plate 70 and the second plate 72 are spring-loaded against each other by biasing spring 92. The second plate 72 acts as a housing for lever 80 and biasing spring 92. The wedge shaped face 88 protrudes through the aperture 90 in the second plate 72 and emerges on the outside of the housing. A tab 94 is located in the periphery of the third plate 74. The third plate 74 acts in part like a cap which fits over the end of the second plate 72. The tab 94 is adapted to be selectively engaged by the wedge shaped face 88 of the lever 80 in response to the rotation of the first plate 70. Cam wheel 40 is rigidly mounted to the clutch assembly 38 and its situated between the second plate 72 and the third plate 74. The whole apparatus is mounted upon one-way roller bearings 96 and an associated support roller bearing 98. The first plate 70 and second plate 72 and its associated parts are free to rotate in one direction about common shaft 50. The third plate 74 is rigidly connected to the common shaft 50 by a key means 99.

In operation the first plate 70 is released when pawl 68 is withdrawn from engagement with tab 76 by the action of the second pattern chain upon cam follower 66. The first plate 70 and the second plate 72 have previously been spring-loaded by the action of biasing spring 92. Consequently, the first plate 70 is drawn into alignment with the second plate 72 by the contraction of biasing spring 92. The movement of the first plate 70 towards the second plate 72 simultaneously causes the roller 84 to move within groove 78. This in turn changes the position of wedge shaped face 88 so that it comes into engagement with rotating tab 94. The engagement in turn draws the whole assembly 38 around approximately 180° until the second tab 76 engages with release pawl 68. The foregoing action also causes cam 40 to rotate approximately 180° along with the clutch assembly 38. After the initial 180° of rotation the action of pawl 68 upon the second tab 76 causes the lever 80 to move in such a fashion that the wedge shaped face 88 disengages from tab 94 and leaves the cam 40 in its new position until such time as the cycle is repeated at which point the whole assembly turns another 180° and returns to its starting position. Details of the lever mechanism 80 may be seen in FIGS. 9*a* and 9*b.*

The rotation of cam 40 is followed by linkage mechanism 42. The linkage mechanism 42 may be seen in detail in FIGS. 6 and 8. A roller and cam follower lever 100 is rotatably mounted on shaft 64 which also serves as a common shaft for the actuater release mechanism 60. Cam follower 100 in turn actuates a push rod 102 and an associated link 104 which is rotatably attached to shaft 106. Shaft 106 is supported by a tensioning means which includes brackets 108. The tensioning of the shaft 106 is accomplished by means of a gear section 110 which engages a bicycle-like chain 112 both ends of which are tensioned by a pair of springs 114. Tension springs 114 are in turn attached to bracket 108 by a yoke or halter 116. A lever 118 is rigidly attached to the shaft 106 at one end and at the other end to link 120. The other end of link 120 is connected to guide bar push lever 122. Accordingly, the back and forth motion of the cam follower 100 is translated into a forward and backward motion of the guide bar push lever 122. The guide bar push lever 122 includes a face 124 which is adapted to engage with a roller 126 rigidly connected to a guide bar slide assembly 128. The guide bar slide assembly 128 is also adapted to be responsive to a pattern chain in a conventional manner as illustrated in FIG. 8. The purpose of the guide bar push lever 122 is to advance or withdraw a particular guide bar by at least one needle spacing.

In operation, the apparatus according to the preferred embodiment of the present invention acts in the following manner. The knitting of a terry cloth towel in the mode illustrated by arrow 18 in FIG. 2 is conventional. However, when the apparatus goes from the mode of arrow 18 to the mode of arrow 20' it is necessary to change one guide bar by at least one needle space. Under certain circumstances it may be desirable to change by more than one needle space. In going from the mode of arrow 18 to the mode of arrow 20', the following sequence of machine events occur. First the second pattern chain 34 comes to a point where it jogs the actuating release mechanism 60. All during this period it will be appreciated that the second set of pattern chain wheels have been revolving at a speed that is approximately 1/50 of the speed of the first set of pattern chain wheels. The second set of pattern chains signals a change in machine mode through cam follower 66, common shaft 64 and pawl release 68. The pawl is caused to withdraw and thereby release one of the two tabs 76 in the periphery of the first plate 70. The spring 92 then draws the first plate 70 closer to the second plate 72 while at the same time rotating lever 80 so that its wedge shaped face 88 engages with tab 94 of the third cap like plate 74. The tab 94 then draws the whole assembly around approximately 180° until the pawl 68 engages with the other tab 76 thereby maintaining the clutch assembly 38 in its second position and simultaneously putting the machine into its second mode as illustrated by arrow 20' of FIG. 2.

The rotation of clutch assembly 38 causes the cam 40 to rotate also. Cam follower lever 100 is adapted to sense the change of the contour of cam 40 and translates the rotation of cam 40 into motion of the linkage system 42. Accordingly, the motion of cam 40 is transmitted through elements 100, 102, 104, 106, 118 and 120 to guide bar push lever 122. The face 124 of the guide bar push lever 122 impinges upon roller 126 which causes the guide bar 130 to move over one needle space as illustrated in FIG. 2. Continued knitting and rotation of the second pattern chain eventually signals the machine to return to its first mode as illustrated by arrow 18. Accordingly, pawl 68 releases the clutch 38 which rotates another 180° and returns to its original starting position. Correspondingly cam 40 returns to its original position and guide bar push lever 122 returns to its original starting position. In this manner the knitting machine may proceed through several different machine modes during the knitting of terry cloth toweling materials.

While the invention has been described with reference to a preferred embodiment thereof, it will be appreciated by those of ordinary skill in the art that various different changes and modifications may be made to the elements of the invention without departing from the spirit and scope thereof.

I claim:

1. An apparatus for producing terry cloth toweling on a warp knitting machine comprising:

a plurality of needles;

a first and a second rotatable pattern chain means;

a guide bar means including a plurality of guide bars for knitting on said needles, said guide bar means being responsive to the motion of said first pattern chain means;

a transfer means for transferring some of the rotational motion of said first pattern chain means to said second pattern chain means, said transfer means comprising a speed varying transmission means, said speed varying transmission means including:

a shaft on which said first pattern chain means is mounted;

a first gear means coaxially mounted on said shaft;

a second gear means also coaxially mounted on said shaft; and, an idler gear means attached to said first pattern chain means and adapted to engage with the teeth of said first and second gear means;

an actuating means responsive to said second pattern chain means;

a clutch means responsive to said actuating means;

a cam means operatively connected to said clutch means; and, a guide bar moving means responsive to said cam means for moving one of said guide bars in response to the movement of said cam means.

2. The apparatus of claim 1 wherein said first and second gear means have a different number of teeth.

3. The apparatus of claim 4 wherein said second gear means has more teeth than said first gear means.

4. The apparatus of claim 5 wherein said second gear means sits on bearings which are rotatable only in one direction.

5. The apparatus of claim 4 wherein said bearings are needle bearings.

6. An apparatus for producing terry cloth toweling on a warp knitting machine comprising:

a plurality of needles;

a first and a second rotatable pattern chain means;

a guide bar means including a plurality of guide bars for knitting on said needles, said guide bar means being responsive to the motion of said first pattern chain means;

a transfer means for transferrng some of the rotational motion of said first pattern chain means to said second pattern chain means;

an actuating means responsive to said second pattern chain means;

a clutch means responsive to said actuating means, said clutch means including:

a first plate having a slot therein;

a lever means adapted to ride in said slot; a second plate through which said lever means emerges, said second plate being coaxially mounted with said first plate and, a third plate coaxially mounted with said first and second plates, said third plate including a tab connected therewith which is selectively engagable with said lever means;

a cam means operatively connected to said clutch means; and, a guide bar moving means responsive to said cam means for moving one of said guide bars in response to the movement of said cam means.

7. The apparatus of claim 6 further including:

a biasing spring connected between said first and second plates.

8. The apparatus of claim 7 wherein said lever means is Z-shaped and includes:

an L-shaped section including a cam portion adapted for sliding engagement in said slot in said first plate; and, a wedge shaped portion adapted for predtermined engagement with the tab connected to said third plate.

9. The apparatus of claim 8 wherein said first plate is a trip-type plate having at least two plate release tabs on its periphery.

10. The apparatus of claim 9 wherein said second plate comprises part of the clutch means housing.

11. The apparatus of claim 10 wherein said third plate comprises a hollow cap and further wherein the tab connected to said third plate is located on the interior periphery of said hollow cap.

12. The apparatus of claim 11 wherein said cam means is connected to and operatively associated with said third plate.

13. The apparatus of claim 12 wherein said clutch means is mounted on one-way bearings.

14. The apparatus of claim 13 wherein said one-way bearings are needle bearings.

15. The apparatus of claim 9 wherein said actuating means comprises:

a pattern chain follower means for following said second pattern chain means;

a rod means connected to said pattern chain follower means; and, a pawl means connected to said rod means and adapted to engage and disengage said tabs on the periphery of said trip-type plate.

16. The apparatus of claim 12 wherein said guide bar moving means comprises:

a cam follower means for following said cam means;

a linkage system connected to said second cam follower means; and, a lever means connected to said linkage system and adapted to move said guide bar means in response to the movement of said cam follower means.

17. An apparatus for transferring the motion of a first pattern chain wheel to a second pattern chain wheel on a warp knitting machine, said apparatus comprising:

a shaft to which said first pattern chain wheel is mounted;

a first gear means coaxially mounted on said shaft;

a second gear means also coaxially mounted on said shaft; and, an idler gear means attached to said first pattern chain wheel and adapted to engage with the teeth of said first and second gear means.

18. The apparatus of claim 16 wherein said first and second gear means have a different number of teeth.

19. The apparatus of claim 18 wherein said second gear means has more teeth than said first gear means.

20. The apparatus of claim 19 wherein said second gear means is mounted on bearings which rotate only in one direction.

21. The apparatus of claim 20 wherein said bearings are needle bearings.

22. A clutch apparatus for imparting an additional motion to the guide bars on a warp knitting machine, said apparatus comprising:

a first plate having a slot therein;

a lever means adapted to ride in said slot;

a second plate through which said lever means emerges, said second plate being coaxially mounted with said first plate;

a third plate coaxially mounted with said first and second plate, said third plate including a tab connected therewith which is selectively engageable with said lever means.

23. The apparatus of claim 22 further including:

a biasing spring connected between said first and said second plates.

24. The apparatus of claim 22 wherein said lever means is Z-shaped and includes:

an L-shaped section including a cam portion adapted for sliding engagement in said slot in said first plate; and, a wedge shaped portion adapted for engagement with said tab in said third plate.

25. The apparatus of claim 24 wherein said first plate is a trip-type plate having at least two plate release tabs on its periphery.

26. The apparatus of claim 25 wherein said second plate comprises part of the clutch apparatus housing.

27. The apparatus of claim 26 wherein said third plate means comprises a hollow cap means with the tab associated therewith located on its interior periphery.

28. The apparatus of claim 27 wherein a cam means is connected to and operatively associated with said hollow cap.

29. The apparatus of claim 28 wherein said clutch apparatus is mounted on one-way bearings.

30. The apparatus of claim 29 wherein said one-way bearings are needle bearings.

31. The apparatus of claim 24 wherein said wedge shaped portion of said lever means includes a first and a second principal section, said first section comprising an inverted V-shaped section and said second section comprising a partially circular section.

* * * * *